US009663254B2

(12) United States Patent
Sdahl et al.

(10) Patent No.: US 9,663,254 B2
(45) Date of Patent: May 30, 2017

(54) METHOD AND FOLDING DEVICE FOR HANDLING L-BOARDS

(71) Applicant: Multivac Sepp Haggenmüller GmbH & Co. KG, Wolfertschwenden (DE)

(72) Inventors: Michael Sdahl, Bad Grönenbach (DE); Elmar Ehrmann, Bad Grönenbach (DE); Gunnar Kurz, Illerbeuren (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 998 days.

(21) Appl. No.: 13/716,393

(22) Filed: Dec. 17, 2012

(65) Prior Publication Data

US 2013/0152512 A1 Jun. 20, 2013

(30) Foreign Application Priority Data

Dec. 19, 2011 (DE) ..... 10 2011 121 642

(51) Int. Cl.

| | |
|---|---|
| ***B65B 9/04*** | (2006.01) |
| ***B65B 11/06*** | (2006.01) |
| ***B65B 25/06*** | (2006.01) |
| ***B65B 49/10*** | (2006.01) |
| ***B65B 49/12*** | (2006.01) |
| ***B65B 61/20*** | (2006.01) |

(52) U.S. Cl.

CPC ..... *B65B 11/06* (2013.01); *B65B 9/04* (2013.01); *B65B 25/065* (2013.01); *B65B 49/10* (2013.01); *B65B 49/12* (2013.01); *B65B 61/20* (2013.01)

(58) Field of Classification Search

CPC ..... B65B 25/065; B65B 49/12; B65B 7/20
USPC ..... 493/405, 416, 437
See application file for complete search history.

(56) References Cited

U.S. PATENT DOCUMENTS 2,907,152 A * 10/1959 Hensgen ..... B65B 25/065 426/413
3,143,837 A * 8/1964 Barr ..... B65B 11/48 53/229
3,315,781 A 4/1967 Eberman et al.
3,742,676 A 7/1973 Lawing et al.
(Continued)

FOREIGN PATENT DOCUMENTS

DE 102008045025 A1 3/2010
DE 202010010699 U1 11/2010
(Continued)

*Primary Examiner* — Stephen F Gerrity
*Assistant Examiner* — Patrick Fry
(74) *Attorney, Agent, or Firm* — Husch Blackwell LLP

(57) ABSTRACT

A folding device and a method for folding over limbs of L-boards at the folding device located upstream of the sealing station in the production direction of a deep-drawing packaging machine. The folding device may include at least one folding member for folding over the limb in a production direction and a hold down device for holding down the folded over limbs. In one embodiment, the hold down device can be activated by a pneumatic cylinder. In another embodiment, the folding device may be moved by a servo motor or pneumatic cylinder. The method includes moving the thermo-formed troughs of a packaging film, placing the product and the L-boards in the trough, folding the limbs of the L-boards, and holding down the limbs once folded.

13 Claims, 7 Drawing Sheets

(56) References Cited

U.S. PATENT DOCUMENTS 3,775,937 A * 12/1973 Devan ..... B65B 51/067 53/136.4
4,003,184 A 1/1977 Shiu
4,034,536 A 7/1977 Mahaffy et al.
4,233,798 A * 11/1980 Helding ..... B65B 7/20 493/177
4,328,657 A 5/1982 Brandmaier et al.
4,342,182 A * 8/1982 Dennis ..... B65B 25/065 493/407
4,375,482 A 3/1983 Maroszek et al.
4,551,964 A 11/1985 Johnson
4,984,248 A 1/1991 Hong
5,087,498 A 2/1992 Nedblake et al.
5,170,611 A 12/1992 Buchko et al.
5,205,110 A 4/1993 Buchko
5,224,919 A 7/1993 Walsh
5,326,577 A 7/1994 Warnock
5,406,665 A * 4/1995 Czopek ..... B08B 11/04 100/170
7,269,933 B2 * 9/2007 Le ..... B65B 7/20 53/376.7
7,748,426 B2 * 7/2010 Feijen ..... B43M 5/042 156/441.5
7,832,444 B2 * 11/2010 Allen ..... B43M 5/042 156/442.1
8,246,527 B2 * 8/2012 Wilkinson ..... B31B 1/54 493/162
2012/0192526 A1 * 8/2012 Spix ..... B65B 25/065 53/396

FOREIGN PATENT DOCUMENTS

DE 102010053872 A1 6/2012
EP 2253543 A2 11/2010
EP 2463204 A2 6/2012

* cited by examiner

METHOD AND FOLDING DEVICE FOR HANDLING L-BOARDS

CROSS-REFERENCE TO RELATED APPLICATIONS

This application claims priority to German Application Number 102011121642.5 filed Dec. 19, 2011, to Michael Sdahl, Elmar Ehrmann, and Gunnar Kurz entitled "Method and Folding Device for Handling L-Boards," currently pending, the entire disclosure of which is incorporated herein by reference.

FIELD OF THE INVENTION

The invention relates to a method for handling L-boards and to a folding device.

BACKGROUND OF THE INVENTION

There are regionally different markets for a portion of cut ham slices which slices are placed on a so-called L-board and are packed in a packaging machine in an airtight manner. A difference between these markets is, for example, that the sliced ham portion is placed on the L-board in different orientations. The L-board serves as a stable support for the product in the subsequent production process and also stabilizes the later package. The L-board may be a coated plate made of cardboard, which has a bending line to fold over the part not covered by the product onto the product. Thus, a part of the product is covered. In a first position the short side not covered by the product is folded over to cover the part of the product with the higher fat content, while in another, opposite position of the portion on the L-board it is folded over the lean part of the product to keep the fat content visible.

Cutting machines, so-called slicers, can often only slice portions that have a single shingle direction. When bringing the portion and the L-board together, i.e. when the portion is placed on the L-board, it is common practice to provide the L-board in different positions. Deep-drawing machines comprise a sealing station for applying a cover film. If the L-boards, which were placed into troughs formed in a lower film, are oriented such that the free parts of the L-board still to be folded over are oriented in the forward production direction, static hold down devices are provided on or upstream of the sealing device to fold over the free part of the L-board onto the product during the motion into the sealing station.

However, if the L-boards are oriented opposite to the production direction and the free part of the L-boards has a trailing orientation, it is currently common practice that operating staff are present in the region of the loading section which is located upstream of the sealing station. In this case of orientation the operating staff have the task of folding over the free part manually before the transport into the sealing station. This may produce unusable packages if the operating staff forget to fold over the free part of an L-board or if the folding over is carried out insufficiently.

SUMMARY OF THE INVENTION

It is the object of the present invention to provide a possibility for automatically folding over free parts of L-boards in a production direction from back to front.

In one embodiment, the inventive method for handling one or more L-boards, each having a product region and a limb pivotable relative to the product region, in a deep-drawing packaging machine comprises the following steps:

- moving troughs in the production direction into the working area of a folding device,
- folding over in the production direction the limbs of the L-boards located in the folding device,
- holding down the folded over limbs by a hold down device, and
- moving the troughs with the L-boards, each having folded over limbs, in the production direction.

This allows a process-reliable folding over and holding down of the folded over limbs without being dependent on operating staff. The method is suited to be carried out in single- or multi-track, preferably two-track deep-drawing packaging machines.

Preferably, the troughs with the L-boards, whose limbs are folded over, are moved into a sealing station immediately after the folding over in order not to unnecessarily increase the length of a deep-drawing packaging machine.

The folded over limbs can be held down by the hold down device from the folding device to the sealing station so as to prevent a folded over limb from folding back, for example, during the motion to the sealing station.

In one embodiment, the hold down device is already activated during the folding over so as to support the folding over of the limbs and minimize the cycle time for a folding over operation and the subsequent holding down by a partially synchronous procedure, thus optimizing the performance of the deep-drawing packaging machine.

The limbs can be folded over while the troughs do not perform a motion relative to the folding device. If the deep-drawing packaging machines work intermittently the time of the motionless forward feed of the troughs may be used to carry out the folding over. This does not require a synchronization of the motion of the folding members with the motion of the troughs, and the complicated controlling of the folding device can be dropped.

In an alternative embodiment, the limbs are folded over while the troughs perform a motion relative to the folding device. This permits that only one row, preferably the last row of L-boards, has to be folded over in the production direction upstream of the sealing station, allowing for a very limited space requirement on the part of the folding device.

The folding over of the limbs may be synchronized with the motion of the troughs in order to optimize the folding over for it to be carried out gently for the limb.

The inventive folding device for a deep-drawing packaging machine for handling one or more L-boards, each having a limb pivotable relative to a product region, comprises at least one folding member for folding over the limb in the production direction. This allows the simultaneous folding over, for example, of more limbs in a row.

The folding over mechanism may comprise a servo motor drive which can be controlled by a controller. This allows an adaptation to different dimensions, preferably to the length of the pivotable limb, and to different feed rates of the trough motion if the folding over is carried out during the motion of the troughs, which will be referred to as dynamic folding over below.

In another embodiment, the drive of the folding members is provided mechanically by means of the motion of the troughs. To this end, the drive of a clamp chain, which is provided for the feed motion of the troughs, can be coupled to the drive of the folding members in order to do without the necessity to provide an additional independent drive for the folding device.

The folding device may be adapted to fold over the limbs of a row or group of L-boards simultaneously. If the folding over is carried out dynamically it is possible to handle a plurality of L-boards which are arranged in a so-called row, side by side, in the production direction, for example in a multi-track deep-drawing packaging machine. If the folding over is carried out statically, with motionless L-boards, the folding device is capable of simultaneously folding over all limbs of L-boards of one packaging format, which consists of several rows and tracks, before this format is fed to the sealing station in a next forward feed.

In one embodiment, a hold down device for holding down the folded over limbs is provided, allowing to feed the folded over limbs in this position to the sealing station in a process-reliable manner and prevent the limbs from folding up again.

In this connection it can be an advantage if the hold down device can be placed onto the folded over limbs of the L-boards so as to allow a simple constructive realization, and to support the folding over operation by folding over the limb into the final, folded over position, preferably by pressing the limb downwardly.

The hold down device can be activated by means of a pneumatic cylinder in order to provide for a cost-efficient construction, which may additionally also include a compressive force adjustable by means of a pressure limiter. Alternatively, also other actuators are possible, such as motors, or the hold down device is directly coupled with the feed motion of the troughs.

In embodiment, the folding member is a bar and preferably runs across all tracks of a format. This allows a simple and cost-efficient realization and, if the bar has a continuous round shape, a gentle folding over of the limb.

The folding over mechanism may comprise a plurality of bars, preferably one bar per row of a format.

The bar can be movable on a circular path about an axis oriented transversely to the production direction and horizontally. This allows a basic position of the bar above the limbs which have not yet been folded over, and a constructively simple restricted guidance of the bar during the folding over motion.

Alternatively, a variable path curve of the folding member is provided to allow an adaptation to different positions and dimensions of the limb of different L-boards.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Like components are designated with like reference numbers throughout the figures.

DETAILED DESCRIPTION OF THE INVENTION

Figure 1:
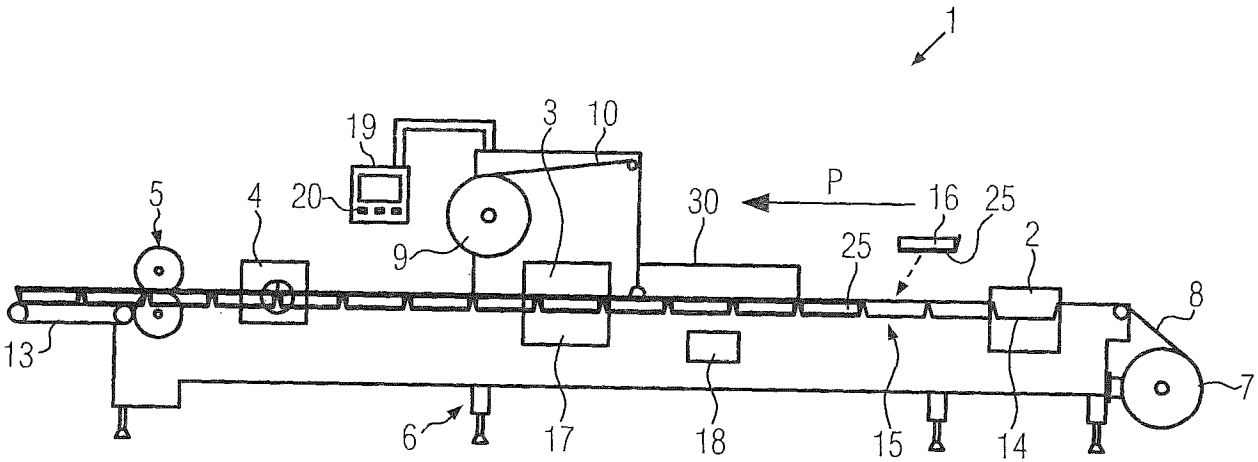
FIG. 1 is a schematic side view of a deep-drawing packaging machine comprising a folding device in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic lateral view of a deep-drawing packaging machine 1. This deep-drawing packaging machine 1 can comprise a forming station 2, a sealing station 3, a cross-cutting device 4 and a longitudinal cutting device 5, which may be arranged in this order on a machine frame 6 in a production direction P. On the input side, a feed reel 7 can be provided on the machine frame 6, from which a film 8 is withdrawn. In the region of the sealing station 3 a material storage device 9 may be provided, from which a cover film 10 is withdrawn. On the output side, the packaging machine can include a removal device 13 in the form of a conveyor belt, by means of which the finished, separated packages are carried away. The packaging machine 1 may further comprise a non-illustrated forward feed device, which grips the film 8 and conveys it further per main work cycle in the production direction P. The forward feed device can be realized, for example, by transport chains disposed on either side.

In the embodiment shown, the forming station 2 is configured as a deep-drawing station, in which troughs 14 are formed in the film 8 by deep-drawing. The forming station 2 may here be configured in such a way that several troughs are formed side by side in the direction perpendicular to the production direction P. In the production direction P, a loading section 15 is provided downstream of the forming station 2, in which the troughs 14 formed in the film 8 are filled with product 16 and L-board 25.

The sealing station 3 can include a closable chamber 17 in which the atmosphere in the troughs 14 can be replaced prior to the sealing, e.g. by gas rinsing with a replacement gas or gas mixture.

The cross-cutting device 4 is configured as a punch separating the film 8 and the cover film 10 between adjacent troughs 14 in a direction transverse to the production direction P. In this connection, the cross-cutting device 4 is operated such that the film 8 is not cut over the entire width, but is not cut through in at least one edge region. This allows a controlled further transport by means of the forward feed device.

In the embodiment shown, the longitudinal cutting device 5 is configured as a knife assembly by means of which the film 8 and the cover film 10 are separated between adjacent troughs 14 and at the lateral edge of the film 8, so that separated packages are provided downstream of the longitudinal cutting device 5.

The packaging machine 1 may further comprise a controller 18, which has the task of controlling and monitoring the processes executed in the packaging machine 1. A display device 19 having operating members 20 serves to visualize and influence the process operations in the packaging machine 1 for or by an operator.

A folding device 30, according to the invention, is illustrated upstream of the sealing station 3, which is disposed above a format of packages. A format defines a group of adjacent packages. For example, a format or a group, respectively, can be formed by two tracks S and two rows R, making four packages. The forward feed device conveys the packages of one format or group of packages further intermittently.

The general mode of operation of the deep-drawing packaging machine 1 will be described briefly below.

The film 8 is withdrawn from the feed reel 7 and conveyed by the forward feed device into the forming station 2. In the forming, station 2 troughs 14 are formed in the film 8 by deep-drawing. In a main work cycle, which corresponds to a forward feed by one format, the troughs 14, together with the surrounding region of the film 8, are conveyed further to the loading section 15. During the feed motion, or motionless forward feed, the troughs are each loaded with an L-board 25 on which product 16 is provided.

Next, in a subsequent main work cycle, the filled troughs 14, together with the region of the film 8 surrounding them, are conveyed further by the forward feed device to arrive underneath a folding device 30.

Figure 1A:
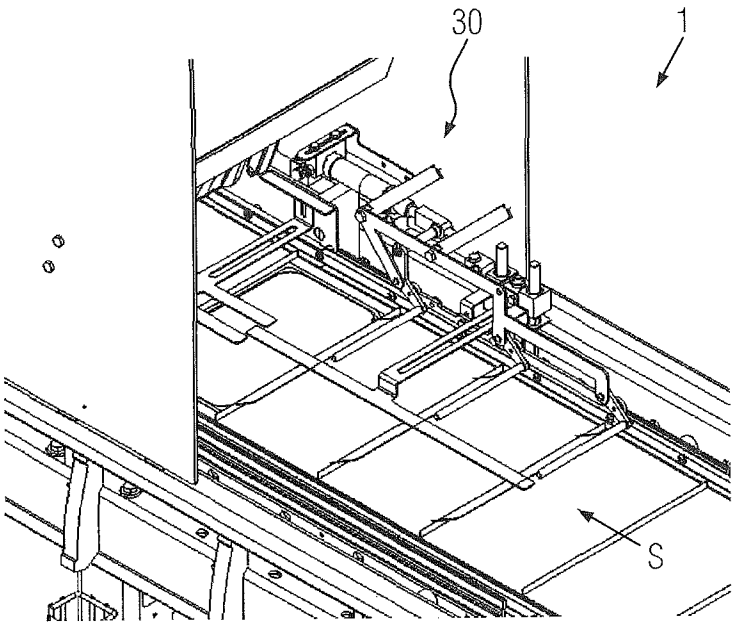
FIG. 1*a* is a top perspective view illustrating a portion of the deep-drawing packaging machine comprising the folding device in accordance with one embodiment of the present invention.
Figure 1B:
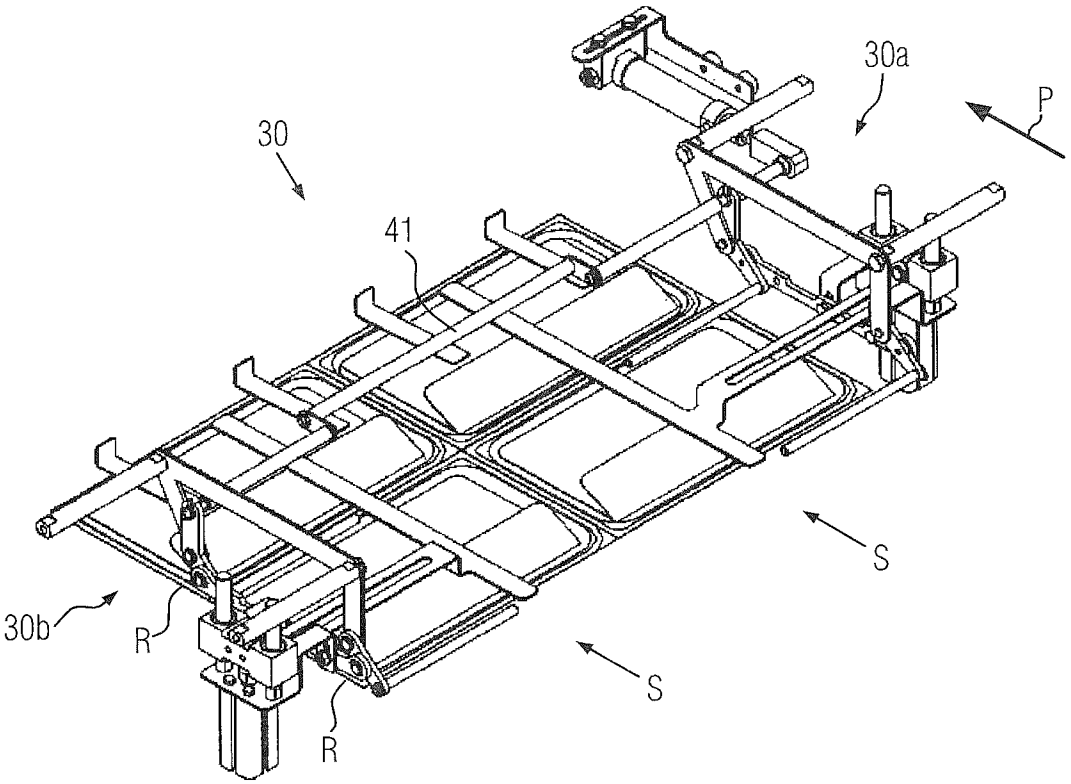
FIG. 1*b* is a top perspective view illustrating a portion of the folding device in accordance with one embodiment of the present invention.

FIG. 1*a* shows a section of the deep-drawing packaging machine 1 with a track S of packages, comprising a first embodiment of the folding device 30. FIG. 1*b* shows a second embodiment of the folding device, realized with two tracks and two rows, without illustrating the deep-drawing packaging machine 1. A transfer member 41 couples a—in the production direction P—right part 30*a* of the folding device 30 for a right track S to a left part 30*b* of the folding device 30 for a left track.

The operating mode of the folding device 30 in the first and second embodiments will be described below by means of FIGS. 2*a* to 2*f*.

Figure 2A:
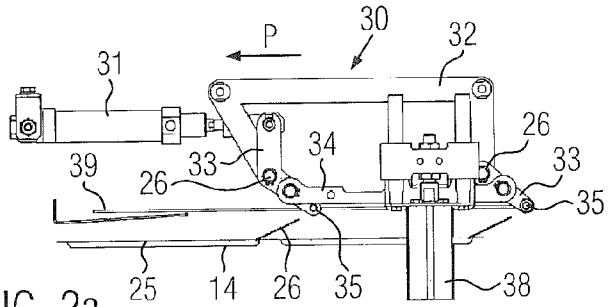
FIGS. 2*a* to 2*f* are side views illustrating six positions of the folding device of FIG. 1 in accordance with one embodiment of the present invention.
Figure 2B:
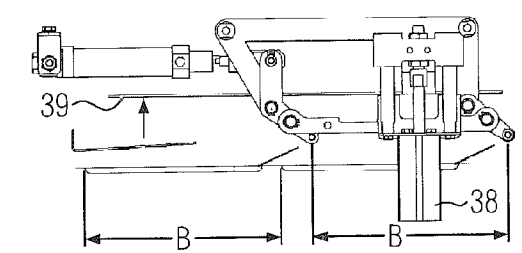
Figure 2C:
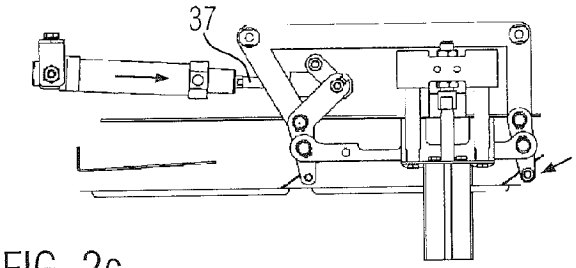
Figure 2D:
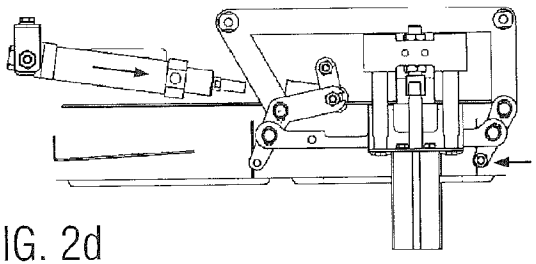
Figure 2E:
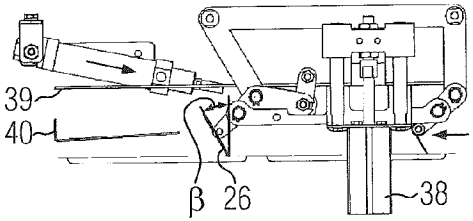

FIG. 2*a* shows a lateral view of the folding device 30, with troughs 14 and the L-boards 25. A cylinder 31 acts on holders 33 by means of a lever mechanism 32, which holders 33 are coupled by a connecting component 34 in such a way that the motion of the holders 33 takes place synchronously and in the same way. Thus, the motion of the folding members provided on the holders 33, in this case folding bars 35, can be identical. The distance of the center axes of the folding bars 35 relative to each other in the production direction P corresponds to the distance B of the troughs 14, e.g. of the front edges of the troughs 14, relative to each other. The folding bars 35 move on a circular path about the axis of rotation 36 of the lever mechanism 32. The motion may be generated by means of the cylinder 31 extending its piston rod 37, and is illustrated in FIGS. 2*a* to 2*f*. After a hold down device 39 was moved upwardly into its basic position by means of another cylinder 38, the folding bar 35 approaches in the production direction P, i.e. from behind, a pivotable limb 26 of the L-board 25 and presses same in the production direction P so as to be inclined towards the product 16 and trough 14, respectively. Alternatively, a servo motor may be provided to drive the lever mechanism 32. As shown in FIG. 1*a*, the drive 31 may be provided on one side and connect the two lever mechanisms 32 of the right part 30*a* and the left part 30*b* by a transfer element 41 (see FIG. 1*b*). Also, two drives 31 on each side are conceivable.

Figure 2F:
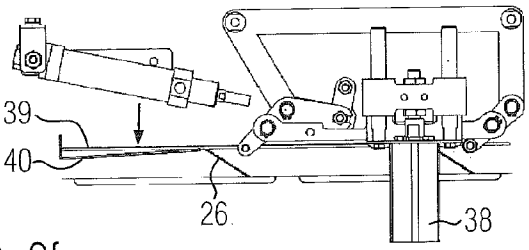

If the inclination β (see FIG. 2*e*) of the limb 26 in the production direction P is greater than 30° relative to a vertical, another cylinder 38 may move a hold down device 39 per track S or a mutual hold down device 39 top-down, preferably in a vertical motion, as shown in FIG. 2*f*. In doing so, the hold down device 39 presses the pivotable limb 26 further down until same is positioned underneath a hold down device 40 in the production direction P. The cylinder 38 can have a pressure limiter to adjust the compressive force, and/or a restrictor for controlling the adjustment speed. After or still during the motion of the hold down device 39, the cylinder 31 retracts the piston rod, thus moving the folding bars 35 back into a basic position, as shown in FIG. 2*a*, with the folding bars 35 being positioned above the pivotable limbs 36 of the L-boards 25.

The hold down device 40 can be attached to the downstream sealing station 3 and serves as an introduction aid in order for the pivotable limbs 26 of the L-boards 25 to remain above the trough 14 during the transport from the folding device 30 into the sealing station 3 where the cover film 10 is sealed onto the troughs 14. When applying the cover film 10 the pivotable limb 26 of the L-board 25 is ultimately pressed onto the product.

By sealing the cover film 10 onto the mold, 14 sealed packages are created, which are separated in the downstream cutters 4 and 5 and conveyed out of the deep-drawing packaging machine 1 by means of the removal device 13.

Figure 3:
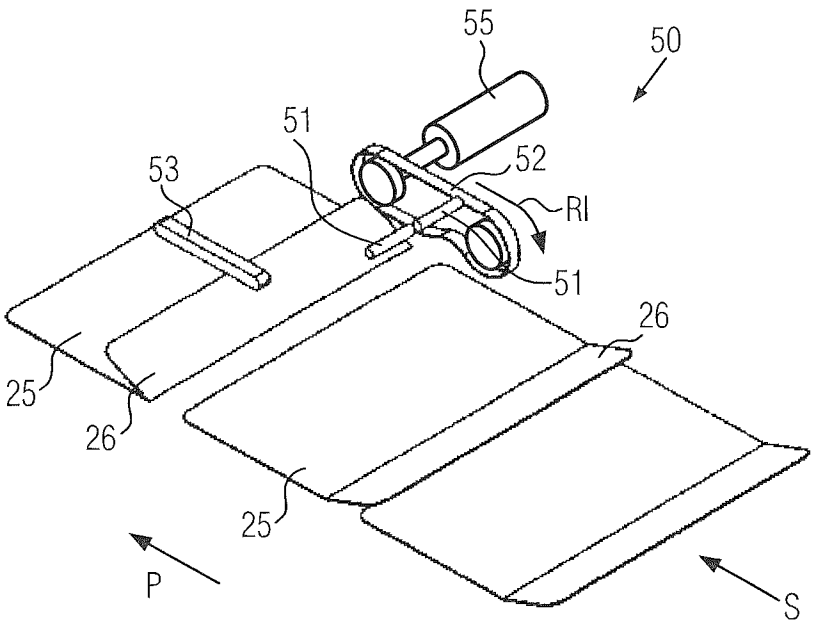
FIG. 3 is a schematic top perspective view shows a schematic view of the folding device in accordance with one embodiment of the present invention.

FIG. 3 shows a third embodiment of the folding device 50 according to the invention, which is provided only for one track S, whereby two (any other number is conceivable, too) folding members, in this case configured as folding bars 51, are attached to a belt 52 or a chain. The folding bars 51 follow a direction of motion RI of the belt 52, which includes a servo motor 55 that is controlled by the controller 18. During the transport of the trough 14 the limb 26 of the L-board 25 can be folded by the folding bar 51 over the L-board 25 and the product 16, respectively, to such an extent that it is subsequently held in this position by a hold down device 53 and can be conveyed further into the sealing station 3. The hold down device 53 may be attached to the sealing station 3 or may be a part of the sealing station 3.

Figure 4A:
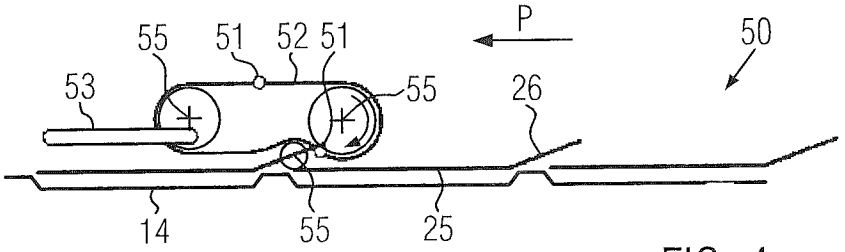
FIGS. 4*a* to 4*c* are side views illustrating three positions of the folding device of FIG. 3 in accordance with one embodiment of the present invention.
Figure 4B:
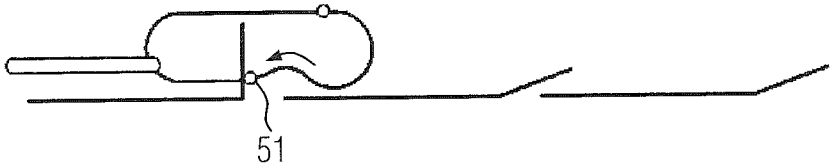
Figure 4C:
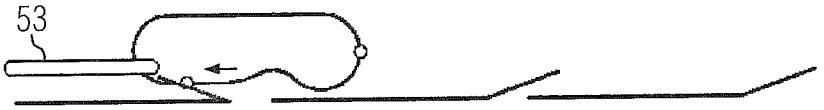

FIGS. 4*a* to 4*c* show the course of the motion of the folding bar 51 in a lateral view.

FIG. 4*a* shows the position of the (lower) folding bar 51 after the trough 14 has been positioned underneath the folding device 50 and the folding bar 51 starts folding over the limb 26 in the production direction P. FIG. 4*b* shows the position during the folding, and FIG. 4*c* shows the position towards the end, whereby the limb 26 was folded over hitherto to such an extent that allows it to move and arrive underneath the hold down device 53.

Alternatively, the folding over may also be carried out during the transport motion of the troughs 14. In this case, the speed of the belt 52 is adapted to the transport speed of the troughs 14, and thus of the L-board 25, such that the folding bar 51 moves faster relative to the L-board 25 so as to be capable of traveling the necessary distance for folding over the limb 26 during the simultaneous transport motion of the L-board 25. The speed of the belt 52 may be variable during the folding operation. Thus, the folding device 50 is adaptable to different dimensions and shapes of the limb 26 as well as to different transport speeds.

In addition, at least two shafts 55 for mounting the belt 52 may be adjustable, thus allowing the folding device to be adapted to different dimensions and shapes of the limb 26 by rendering the course of the path of the folding bar variable.

Figure 5:
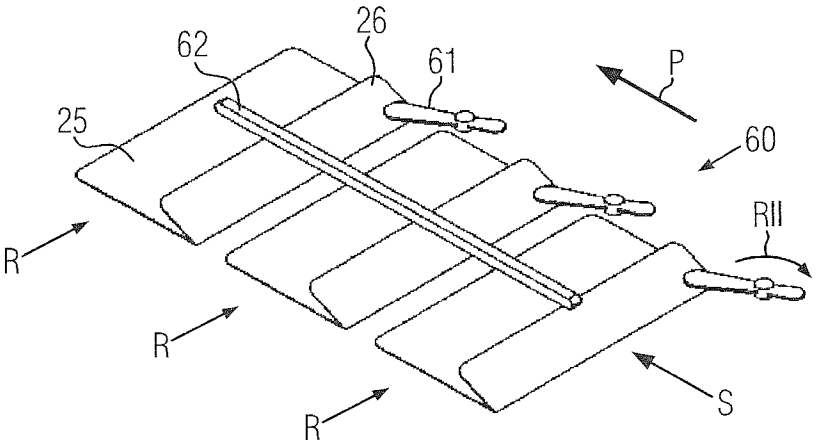
FIG. 5 is a schematic top perspective view illustrating the folding device in accordance with one embodiment of the present invention.

FIG. 5 shows another embodiment of the folding device 60 according to the invention, which comprises folding members in correspondence with the number of rows R of a format, in this example three folding blades 61 as folding members. The folding blades 61 can be disposed laterally of the L-board 25 in the production direction P. The folding blades 61 can have at least one or two blades which may be twisted similar to a ship's propeller and have rounded edges so as to avoid a damage to the limb 26 during the folding operation. The folding blades 61 rotate in a direction RII to fold over the limbs 26. The rotation of the folding blades 61 and the folding operation can be accomplished with motionless L-boards 25 or with L-boards 25 moving in the production direction P. The troughs 14 are not illustrated in the schematic view. A hold down device 62 is disposed above the format and is vertically movable to keep the limbs 26 folded over the L-board 25 by means of the folding blades 61 in this folded over position until they are conveyed further into the sealing station 3. The hold down device 62 may also press a partially folded over limb 26 further down, so that the folding blade 61 need not carry out the entire folding operation. Alternatively, the hold down device 62 may be lifted up again into a basic position prior to the transport motion, provided that the L-boards 25 are configured such that the pivotable limb 26 remains in this position and does not fold back up again induced by the product 16 or the transport motion and, consequently, is located outside the trough when entering the sealing station 3.

Figure 6:
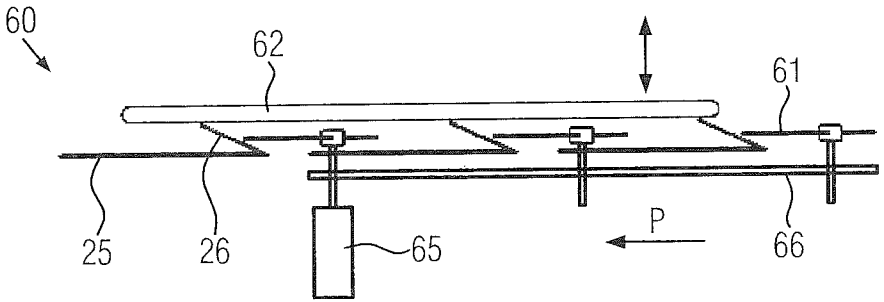
FIG. 6 is a schematic side view illustrating the folding device of FIG. 5 in accordance with one embodiment of the present invention.

FIG. 6 shows a servo drive 65 synchronously driving the folding blades 61 by means of a transfer member 66, e.g. a toothed belt. The controlling is accomplished by the controller 18 of the deep-drawing packaging machine 1. The limb 26 shown in FIG. 6 has already been folded over by the folding blades 61, and the hold down device 62 has been moved down. In this case, the rotational speed of the folding blades 61 is greater than the transport speed of the troughs 14 and the L-boards 25, respectively, so as to fold over the pivotable limbs 26 during the transport motion by means of the simultaneous motion of rotation of the folding blades 61, which is adapted to the transport motion.

This embodiment may also be used for a deep-drawing packaging machine 1 having two tracks and multiple rows. In this case, a number of folding blades 61 is disposed on the right of a first—in the production direction P—right track S, and a second row of folding blades 61 is disposed on the left of a second left track S.

In a modification of this embodiment, only one folding blade 61 is used.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method for handling in a deep-drawing packaging machine one or more L-boards, each having a product region and a limb pivotable relative to the product region, the method comprising the following steps:

moving one or more troughs containing an L-board in a production direction into a working area of a folding device;

folding over in the production direction the limb of the one or more L-boards located in the folding device;

lowering a hold down device using a pneumatic cylinder after the folding over step to contact with the folded over limb of the one or more L-boards;

holding down the folded over limb of the one or more L-boards with the hold down device; and moving the one or more troughs containing the L-board having the folded over limb in the production direction.

2. The method of claim 1, further comprising moving the one or more troughs, with the L-board having the folded over limb, into a sealing station immediately after the lowering the hold down device step, and wherein the lowering the hold down device step occurs immediately after the folding over step.

3. The method of claim 2, further comprising holding down the folded over limb of the one or more L-boards with the hold down device from the folding device to the sealing station.

4. The method of claim 1, further comprising stopping the movement of the one or more troughs relative to the folding device during the folding over step.

5. The method of claim 1, further comprising timing the folding over step in relation to the moving the one or more troughs steps.

6. The method claim of claim 1 further comprises the steps of:

advancing the one or more troughs containing the L-board in the production direction to a sealing station after the folding over in the production direction the limb of the one or more L-boards step, and holding down the folded over limb of the one or more L-boards with a second hold down device disposed downstream of the folding device during the advancing the one or more troughs containing L-boards in the production direction to the sealing station step, wherein said second hold down device has a fixed position.

7. A folding device for a deep-drawing packaging machine for handling one or more L-boards, each L-board having a limb pivotable relative to a product region, the folding device comprising:

at least one folding member for folding over the limb of the one or more L-boards in a production direction;

a first hold down device for holding down the folded over limb of the one or more L-boards, wherein the first hold down device is disposed for movement resulting from a pneumatic cylinder operably connected to said first hold down device; and a second hold down device immediately downstream of said first hold down device for continuing to hold the folded over limb of the one or more L-boards as said one or more L-boards advance to a sealing station, said second hold down device disposed at a fixed height.

8. The folding device of claim 7, wherein the at least one folding member comprises a servo motor drive which can be controlled by a controller.

9. The folding device of claim 7, wherein the folding device is adapted to fold over the limbs of a row or group of L-boards simultaneously.

10. The folding device of claim 7, wherein the first hold down device is disposed for movement between a raised and lowered position, wherein in the lowered position, the first hold down device is disposed to engage the folded over limb of the one or more L-boards.

11. The folding device of claim 7, wherein the at least one folding member is a bar.

12. The folding device of claim 11, wherein the bar runs across all tracks of a group of adjacent L-boards.

13. The folding device of claim 11, wherein the bar is movable on a circular path about an axis oriented transversely to the production direction and horizontally.

* * * * *